United States Patent [19]

Henrie et al.

[11] 4,085,017

[45] Apr. 18, 1978

[54] RECOVERY OF COPPER AND NICKEL FROM ALLOYS

[75] Inventors: Thomas A. Henrie, Silver Spring, Md.; Roald E. Lindstrom, Reno; Kenneth P. V. Lei, Sparks, both of Nev.

[73] Assignee: The United States of America as represented by the Secretary of the Interior, Washington, D.C.

[21] Appl. No.: 830,517

[22] Filed: Sep. 6, 1977

[51] Int. Cl.[2] ..... C25C 1/24; C25C 1/08; C25C 1/12

[52] U.S. Cl. ..... 204/123; 204/124

[58] Field of Search ..... 204/123, 124, 125

[56] References Cited

U.S. PATENT DOCUMENTS 2,389,691 11/1945 Schumacher et al. ..... 204/124

FOREIGN PATENT DOCUMENTS 1,060,150 6/1959 Germany ..... 204/124

291,989 2/1971 U.S.S.R. ..... 204/123

*Primary Examiner*—T. M. Tufariello

*Attorney, Agent, or Firm*—William S. Brown; Donald A. Gardiner

[57] ABSTRACT

Copper and nickel are recovered from alloys by electrolysis in a cell employing the alloy as anode. In addition, the electrolytic cell has separate anode and cathode sections, with an intermediate liquid copper-mercury alloy electrode between the anode and cathode sections.

2 Claims, 1 Drawing Figure

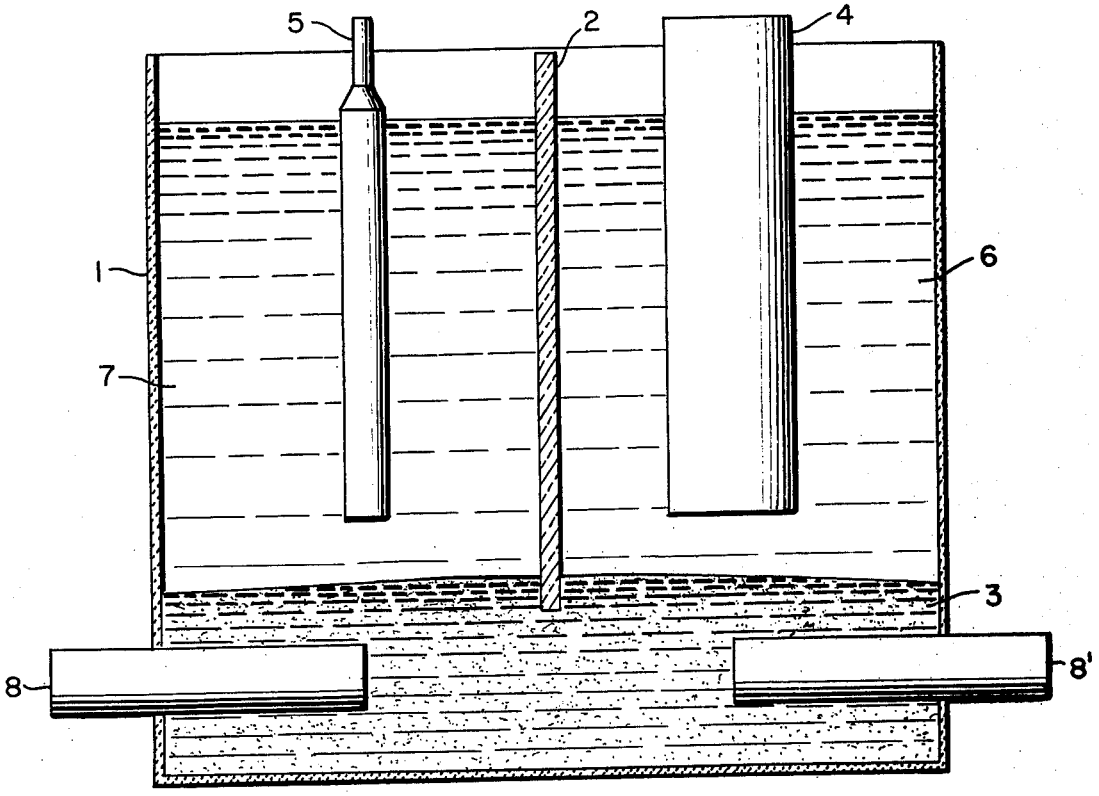
5
2
4
1
6
7
3
8
8'

RECOVERY OF COPPER AND NICKEL FROM ALLOYS

Copper and nickel are important industrial metals, and efficient methods for reclaiming these metal values from scrap waste material are important in maintenance of adequate supplies of the metals. Considerable amounts of copper-nickel alloys are available for recycle, and metallurgical processes for recovery of these metals from the waste alloys are needed.

We have now found, according to the process of the invention, that copper and nickel can be recovered from alloys, efficiently and without environmental pollution, by means of an electrolytic process employing the copper-nickel alloy as anode and a liquid copper-mercury alloy as an intermediate electrode between separate anode and cathode sections of an electrolytic cell.

This process will be generally described with reference to the FIGURE which illustrates diagrammatically an embodiment of an apparatus suitable for use in the process.

Referring to the FIGURE, the electrolytic cell consists of container 1, impervious barrier 2, intermediate Cu—Hg alloy electrode 3, Cu–Ni alloy anode 4, cathode 5, anode section 6, and cathode section 7. The Cu—Hg intermediate electrode is heated by passing a.c. or d.c. current through iron conductors 8 and 8'. The container may consist of any material, such as ceramics, conventionally used for electrolytic cells, provided it is substantially inert and durable with respect to the Cu—Hg alloy at the operating temperature.

The impervious barrier serves to divide the cell into cathode and anode sections, and is, therefore, essentially impervious to ions present or formed in either anode or cathode section during electrolysis. Generally, glass is suitable for this purpose, but other materials such as Teflon (tetrafluoroethylene), or any material that is capable of withstanding the chemical environment may also be used. In addition, the specific form or structure of the barrier is not critical, provided only that it serves to divide the cell into anode and cathode compartments of appropriate dimensions.

The intermediate electrode consists of a copper-mercury alloy containing about 0.5 to 5 weight percent copper. It is maintained, by conventional means such as an electric current or external heat source, at an operating temperature sufficient to maintain the alloy in the liquid state, e.g., about 85° to 100° C. The liquid alloy may be employed in any convenient arrangement in the cell, provided only that it serves to interconnect the anode and cathode sections of the cell. Generally, the most convenient arrangement will be that illustrated in the FIGURE in which the liquid alloy constitutes a layer on the bottom of the cell, with the impervious barrier being immersed in the alloy. The thickness of the alloy layer is not critical, provided it is sufficient for efficient transfer of metallic copper from anode section to the cathode section, as more fully discussed below. Optimum thickness will depend on variables such as size and configuration of the cell, type and amount of copper ore or concentrate, composition of anolyte and catholyte, type of electrodes, and operating temperature, and is best determined experimentally.

The anode consists essentially of the copper-nickel alloy material from which copper and nickel values are recovered by the process of the invention. Typical, and most common, of such alloys is Monel alloy, which is composed predominantly of nickel and copper, generally with very small quantities of carbon, manganese, iron, sulfur, and silicon. The anode may be in any conventional form for electrolytic processes, e.g., plates, rods, etc., optimum forms and sizes being dependent on the above-mentioned variables, as well as the nature of the scrap material constituting the alloy.

The cathode may be any conventionally employed in electrolytic processes involving copper deposition, e.g., electrowinning or electrorefining. Suitable cathode materials include stainless steel, copper, titanium, and other materials providing an adherent surface for deposition of copper. The cathode may also be employed in any conventional form and size.

Suitable anodic electrolyte solutions are those conventionally employed in electrolytic processes for dissolution of copper or nickel. Examples of such solutions are acidic solutions of copper or nickel salts, such as copper sulfate, copper chloride, nickel sulfate, nickel nitrate, or mixtures thereof. Sulfuric acid is generally preferred for providing the required acidity, although other acids such as hydrochloric and nitric acids may be used. Sulfuric acid alone may be satisfactory as the anolyte solution. Optimum concentrations of copper, nickel, etc., and optimum pH of the electrolyte solution, will again depend on the above variables, but generally copper or nickel ion concentrations in the range of about 10 to 50 g/l, and a pH of about 0.4 to 1.5, are satisfactory.

The catholyte consists of an aqueous electrolyte solution capable of providing efficient deposition of copper at the cathode, as well as enhancing formation of a good plating surface. These solutions are also conventional and will generally consists of an acidic aqueous solution of a copper salt such as copper sulfate or copper chloride. The solution will usually also contain an acid such as sulfuric acid or hydrochloric acid in an amount to provide a pH of about 0.5 to 1.5. Again, optimum concentrations are best determined empirically, but a copper ion concentration of about 30 to 60 g/l is generally satisfactory.

Electrolysis is accomplished by means of a d.c. current from a conventional source. Suitable voltages and current densities will generally be in the range of about 5 to 15 volts and 10 to 50 amp/ft$^2$. Time required may vary considerably with the above-discussed variables, but a period of about 10 to 50 hours will usually be sufficient for substantial dissolution of the alloy and deposition of metallic copper at the cathode.

Operation of the process of the invention is based on the ready formation of a liquid alloy of copper and mercury, which is used as an intermediate electrode separating anode and cathode sections of the electrolytic cell. Mass transfer between anode section and cathode section is by means of copper atoms as a component of the liquid alloy. Copper ions, produced by electrolytic dissolution of the alloy are reduced at the intermediate electrode-anolyte interface, migrate through the intermediate electrode and are reoxidized at the intermediate electrode-catholyte interface. Electrons to maintain electrical balance are transferred in the opposite direction through the intermediate electrode.

This separation of the anolyte and catholyte by a metallic system automatically eliminates ionic flow between anolyte and catholyte sections, thereby permitting the use of different components in the anolyte and catholyte sections. Thus, the anolyte section may contain cations and anions that enhance dissolution of the alloy, while the catholyte may contain components best suited to formation of copper plate at the cathode. At the same time, because of the high solubility of copper in mercury, as compared to that of nickel and iron, at the operating temperature, selective migration of copper from the anolyte, through the intermediate electrode, to the catholyte occurs, separation of copper from nickel and iron thereby being achieved.

The process of the invention may result in some transfer of mercury to the cathode deposit; however, a separation of mercury and copper can be easily achieved by distillation or electrolysis. For example, electrolysis in a $CuSO_4$ solution has been found to produce copper of 99.94 percent purity.

Considerable accumulation of nickel ions in the anolyte, e.g., in concentrations as great as about 70 g/l, during the electrolytic process has been found to have little effect on transference and deposition of copper at the cathode. However, selective nickel ion reduction in the anolyte may be readily accomplished by adjusting the pH and circulating the anolyte through a solvent extraction system employing a solvent such as naphthenic acid. The raffinate-anolyte containing smaller amounts of nickel and nearly all the copper is returned to the anode compartment. A similar process may also be employed for extraction of nickel from the anolyte solution on completion of the electrolysis, thus forming an electrolyte solution suitable for electrowinning of nickel values.

The process of the invention may be carried out in batch operations, or in continuous operations in which the anolyte solution and the catholyte solution are continuously circulated in the cell. The process is also not limited to the use of single compartmented cells of the type illustrated in the FIGURE, but may employ multicompartmented cells with anode and cathode assemblies arranged alternately.

The invention will be more specifically illustrated by the following examples.

EXAMPLE 1

880 g of Monel alloy anode containing 69 pct Ni, 30 pct Cu, and 0.25 pct Fe was electrolyzed in a $CuCl_2$—HCl solution which contained 50 g/l Cu at pH 1. Similar solution was used as the catholyte but contained 45 g/l Cu at pH 1. The volume of anolyte and catholyte was each 3 liters which was pumped into the respective cell compartment, and the overflow was returned to its respective reservoir. The liquid alloy intermediate electrode which separated the anode and cathode compartment weighed 4,035 g and contained 5 pct Cu and 95 pct Hg. The temperature of the intermediate electrode was kept at 100° C, and the electrolyte's temperature at 76° C. Electrolysis was made in 24 hours with a current of 2.5 amp, 6.5 volts, corresponding to an initial current density of 11 amp/ft$^2$ for the anode and the cathode. 44 g of cathode deposit was obtained which contained 81 pct Cu and 19 pct Hg. After the electrolysis, the anolyte contained 39 g/l Cu, 15 g/l Ni, and 0.06 g/l Fe, and the catholyte contained 44 g/l Cu and 0.02 g/l Ni. The weight loss of the anode was 66 g. The liquid alloy intermediate electrode contained 5.4 pct Cu after the electrolysis.

This result shows the feasibility of separating and recovering copper and nickel from the Monel alloy. Nickel and iron were dissolved and remained essentially in the anolyte. Copper was also dissolved in the anolyte but migrated to the catholyte through the intermediate electrode, and deposited on the cathode.

EXAMPLE 2

742 g of Monel alloy containing 69 pct Ni, 30 pct Cu, and 0.25 pct Fe was electrolyzed in a $CuSO_4$—$NiSO_4$—$H_2SO_4$ solution at pH 1.2 containing 38 g/l Cu and 16 g/l Ni. The catholyte at pH 1 contained 48 g/l Cu. The liquid alloy intermediate electrode weighed 4,181 g and contained 0.5 pct Cu and 99.5 pct Hg. The temperature of electrolytes and intermediate alloy were kept at 76° and 100° C, respectively. Electrolysis was made in 19.8 hours with a current of 5 amp, 9.5 volts, corresponding to an initial current density of 22 amp/ft$^2$ for the anode and cathode. 40 g of cathode product was obtained which contained 91 pct Cu and 9 pct Hg. After the electrolysis, the anolyte contained 27 g/l Cu, 31 g/l Ni, and 0.06 g/l Fe, and the catholyte contained 49 g/l Cu and 0.05 g/l Ni. The weight loss of Monel alloy anode was 66 g. The intermediate electrode contained 0.8 pct copper after electrolysis.

This result shows that separation of copper from nickel in the alloy was possible even though the anolyte contained an initial ratio of Cu-to-Ni approximately 2:1. The accumulation of nickel in the anolyte had no effect on the transference of copper to the catholyte through the intermediate electrode and on the deposition of copper.

EXAMPLE 3

888 g of Monel alloy containing 69 pct Ni, 30 pct Cu, and 0.25 pct Fe was electrolyzed in a $H_2SO_4$ solution at pH 0.45 which contained no metal ions. The catholyte was $CuSO_4$—$H_2SO_4$ solution at pH 1.2 containing 59 g/l Cu. The liquid alloy intermediate electrode weighed 4,112 g and contained 0.5 pct Cu and 99.5 pct Hg. The temperature of electrolytes and intermediate electrode were kept at 76° and 100° C, respectively. Electrolysis was made in 37.6 hours with a current of 2.5 amp, 6.5 volts, corresponding to an initial current density of 11 amp/ft$^2$ for the anode and cathode. 81.8 g of cathode deposit was obtained which contained 90 pct Cu and 10 pct Hg. After the electrolysis, the anolyte contained 0.84 g/l Cu, 27.5 g/l Ni, and 0.06 g/l Fe, and the catholyte contained 45 g/l Cu and 0.09 g/l Ni. The weight loss of the anode was 121 g. The intermediate electrode contained 0.54 pct Cu after the electrolysis.

This result shows that the separation of copper from nickel in the alloy can be achieved by the use of $H_2SO_4$ solution as the anolyte. Since copper transferred to the catholyte and deposited on a cathode, a relatively pure nickel-anolyte resulted which could be easily processed to recover the nickel.

EXAMPLE 4

767 g of Monel alloy containing 69 pct Ni, 30 pct Cu, and 0.25 pct Fe was electrolyzed in a $Ni(NO_3)_2$—$HNO_3$ solution at pH 0.9 containing 36 g/l Ni. The catholyte was $CuSo_4$—$H_2SO_4$ solution at pH 1.3 containing 54 g/l Cu. The liquid alloy intermediate electrode weighed 4,329 g and contained 1.2 pct Cu and 98.8 pct Hg. The temperature of electrolytes and intermediate electrode were kept at 76° and 100° C, respectively. Electrolysis was made in 50 hours with a current of 2.5 amp, 6.5 volts, corresponding to an initial current density of 11 amp/ft$^2$ for the anode and cathode. 92.5 g of cathode deposit was obtained which contained 90 pct Cu and 10 pct Hg. After the electrolysis, the anolyte contained 3.9 g/l Cu, 74 g/l Ni, and 0.08 g/l Fe, and the catholyte contained 38.2 g/l Cu and 0.1 g/l Ni. The weight loss of the anode was 165.5 g. The intermediate electrode contained 1.24 pct Cu after the electrolysis.

This result demonstrates the flexibility in the selection of anolyte systems. Although the anolyte initially contained only Ni ions, dissolution of the alloy in the nickel electrolyte furnished a source of copper ions to the catholyte by the copper migration through the intermediate electrode. The example also reaffirms that accumulation of nickel in the anolyte has little or no effect on the transference and deposition of copper.

We claim:

1. A process for recovery of copper and nickel from alloys comprising providing an electrolytic cell consisting essentially of (1) an anode section containing an aqueous electrolyte solution and an anode consisting essentially of an alloy of copper and nickel, (2) a separate cathode section, and (3) an intermediate electrode consisting essentially of a liquid copper-mercury alloy at a temperature of about 85° to 100° C between said anode section and said cathode section, and operating said cell for a time sufficient to effect substantial dissolution of the copper-nickel alloy anode and deposition of metallic copper at the cathode.

2. The process of claim 1 in which the copper-nickel alloy of the anode consists essentially of Monel alloy.

* * * * *